United States Patent [19]

Stoll, III

[11] 4,091,960

[45] May 30, 1978

[54] THREADED BUNGHOLE FOR PLASTIC CONTAINERS

[75] Inventor: Andrew Joseph Stoll, III, Toledo, Ohio

[73] Assignee: Owens-Illinois, Inc., Toledo, Ohio

[21] Appl. No.: 821,599

[22] Filed: Aug. 4, 1977

[51] Int. Cl.[2] ..... B65D 53/00

[52] U.S. Cl. ..... 220/304

[58] Field of Search ..... 220/288, 304; 285/201-204; 150/.5

[56] References Cited

U.S. PATENT DOCUMENTS 3,432,069 3/1969 Craig ..... 220/304 X 3,437,231 4/1969 Carpenter ..... 220/304 X

*Primary Examiner*—George T. Hall

*Attorney, Agent, or Firm*—Charles S. Lynch; Richard D. Heberling

[57] ABSTRACT

A threaded bunghole structure for plastic containers is disclosed which requires no gaskets, has a warp-free sealing surface, and is leakproof. In one embodiment, the structure is formed by insert blowmolding over a female-threaded metal flange such that the outermost plastic-to-metal interface border is disposed inwardly from the sealing surface. In a second embodiment, an annular metal insert is disposed between plastic blowmolded threads and a sealing surface.

6 Claims, 3 Drawing Figures

THREADED BUNGHOLE FOR PLASTIC CONTAINERS

BACKGROUND OF THE INVENTION

The present invention relates to the art of blowmolding free standing plastic drums, and more specifically to a bunghole structure for blowmolded plastic drums. The steel drum has been the most successful drum in the recent past utilized for purposes of handling, storing, and transporting bulk quantities of fluid materials on the order of at least 30 gallons, and more typically on the order of about 50 to 60 gallons. The drum most commonly employed has a nominal volume of approximately 55 gallons.

More recently, however, freestanding tight-head plastic drums have been developed and made available, but they have not yet obtained their full potential. It should be appreciated that such drums, especially those which are molded as a single piece article, offer many highly desirable characteristics. Some of these desirable characteristics include, for example, low price, low shipping costs, a wide scope of product applications without the need for liners, high resistance to the detrimental influence of weather, lightweight, rust resistance, dent resistance, and aesthetic appearance. Some of the deterrents to the wider acceptance and usage of plastic drums have been cross-threading of the plastic threads and warping of the sealing surface in the bunghole.

Cross-threading occurs most frequently when the user has difficulty screwing the closures and other devices into the bunghole. The user oftentimes forces the engagement without realizing that, because of the relatively soft plastic, the bunghole threads may be permanently damaged, thereby rendering the drum useless for further intended needs. The difficulty of insertion may be due to a canted closure or to warping of the bunghole itself. Additionally, however, cross-threading or other damage to the plastic threads also occurs during government required quality control drop tests such as under the United States Department of Transportation Regulations Governing Transportation of Hazardous Materials Section 178.19, Specification 34. The deformation of the bunghole and closures occurs at the moment of impact resulting in either immediate expulsion of the closure or, as is the case with all cross-threaded or otherwise damaged bungholes, in leakage or contamination of the contents.

Warping of the bunghole, and especially the sealing surface, results from uneven drum wall shrinkage of the plastic during the post-blow mold cooling stage of manufacture. Such warping prevents the formation of a good seal without the use of sufficiently thick and elastic gaskets. One solution to the warping problem has been the technique of insert blowmolding over a prefabricated threaded plastic flange. However, the technique did nothing for the cross-threading problem and sometimes, created leakage difficulties at the body/flange interface.

Attempts have been made to insert blowmold over threaded metal flanges but have met with failure, primarily due to leakage between the plastic-to-metal interface. The leakage problem can be better appreciated by an understanding of some of the other tests which the drums commonly must pass. Typical government regulations require plastic drums to retain a hydrostatic internal pressure of 15 PSI at equilibrium for five minutes without showing a pressure drop or evidence of leakage. Such pressure is often adequate to break the minimal seal at the plastic-to-metal interface, thereby resulting in a failure of the test. Another test requires a 30 gallon plastic drum filled to 98 percent capacity with water to withstand a compressive load of 1800 pounds applied to the load bearing areas of the top of the container for a period of not less than 48 hours without buckling of the side walls sufficient to cause damage, and in no case may the maximum top to bottom deflection be more than one inch. This test generally applies only to 30 gallon and smaller drums. The 55 gallon drum must pass all of the tests for the smaller drums, except that the load to be applied in the compression test is 2400 pounds. Until the present invention, almost all plastic drums constructed with insert blowmolded metal flanges failed the compression test because they leaked at the plastic -to- metal interface. Even leakage of the headspace air in the drum resulted in buckling and excessive top to bottom deflection since the entrapped air provides a necessary resistance to the above-described high compressive forces. Attempts have been made to solve the leakage problem by adhering the plastic to the metal insert but have not been successful.

SUMMARY OF THE INVENTION

The present invention relates to both the cross-threading and the warping problems of prior art threaded bungholes formed in blowmolded plastic drums. In its simplest embodiment, the invention comprises a bunghole structure manufactured by blowmolding a plastic material around and over the top surface of tubular metal insert. The plastic over the top surface of the insert provides a sealing surface such that the adjacent edges at the plastic -to- metal interface are not exposed to the atmosphere after insertion of the plug thereby preventing the leakage problem at the bunghole. The metal insert also provides rigid support in the area of the bunghole which eliminates warping of the sealing surface and, in many cases, eliminates the need for gaskets, and minimmizes the hazard of cross-threading.

In one embodiment, the metal insert itself will be threaded so that the plastic threading may be supplemented or eliminated. However, in another embodiment the threads are molded in the plastic material adjacent the metal insert on the opposite side from the sealing surface. In either case, the plastic sealing surface is clamped between the metal insert and a closure threaded into the bunghole structure.

It is therefore an object of the present invention to provide a plastic drum bunghole structure with a rigid metal insert to prevent warping of the sealing surface and to eliminate the need for gaskets.

It is also an object of this invention to minimize or eliminate cross-threading of plastic drum bungholes.

It is still a further object of this invention to provide a leakproof bunghole structure for plastic drums.

Other objects and advantages of the invention will be apparent to those skilled in the art from the following detailed description of a preferred embodiment of the invention, with reference made to the drawings.

DETAILED DESCRIPTION

Figure 1:
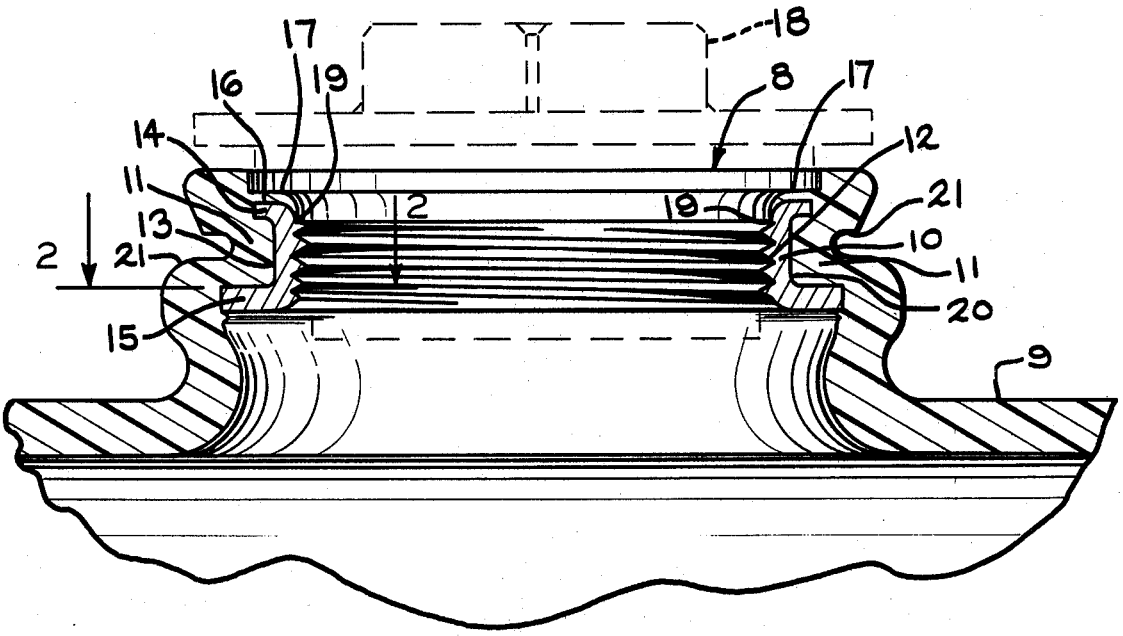
FIG. 1 is a cross-sectional view of a bunghole structure in accordance with one embodiment of this invention.
Figure 2:
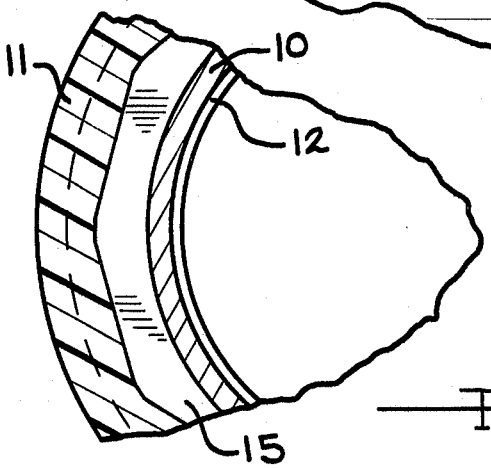
FIG. 2 is a sectional view along line 3—3 of FIG. 1.

FIGS. 1 and 2 illustrate a tubular metal insert 10 over which have been blowmolded a plastic overlayer 11 to form a bunghole 8 for a plastic drum 9. The insert 10 has internal threads 12, an outside cylindrical surface 13, and upper and lower flanges 14 and 15 respectively. As best seen in FIG. 2, the lower flange 15 forms a 12-sided polygon.

The plastic overlayer 11 tightly covers the outside cylindrical surface 13 and the flanges 14 and 15 such that the metal insert 10 is secured from horizontal, vertical, and rotational motion relative to the overlayer 11. Although the flange 15 is described as being 12-sided, it should be clear that any number of sides or other designs would serve as well to prevent rotational movement.

The overlayer 11 covers a top surface 16 of the metal insert 10, or in this cae, the top surface 16 of the upper flange 14, so as to form a sealing surface 17 for an engaging plug or closure 18 (shown in dashed lines). Also, an uppermost border 19 of a plastic-to-metal interface 20 between the overlayer 11 and the insert 10 is inward from the sealing surface 17, so that no part of the interface 20 is exposed to the atmosphere after insertion of the plug or closure 18. Such a location for the interface border 19 prevents air or product leakage from the drum during normal use and during quality control tests. The sealing surface 17 additionally functions as a gasket. The overlayer 11 may include exterior features 21 which may serve to further interjoin with and support pumping and other dispensing equipment attached to the bunghole 18, or support tamperproof cap seals.

Figure 3:
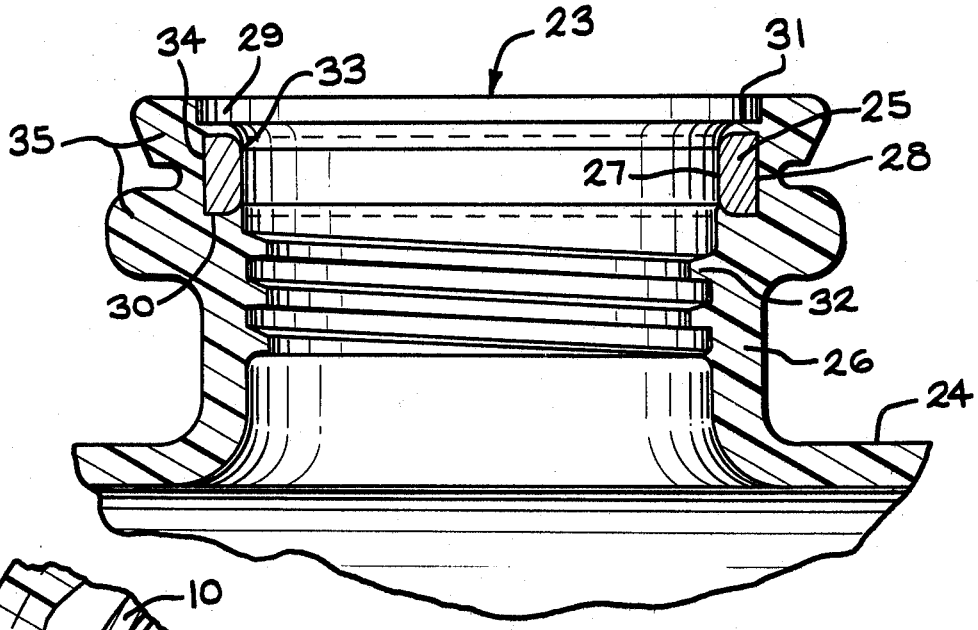
FIG. 3 is a cross-sectional view of a bunghole structure in accordance with another embodiment of this invention.

FIG. 3 also illustrates a tubular metal insert 25 over which has been blowmolded a plastic overlayer 26 to form a bunghole 23 for a plastic drum 24. The insert 25 has inside and outside cylindrical surfaces 27 and 28 respectively and top and bottom surfaces 29 and 30 respectively.

The plastic overlayer 26 covers and tightly engages the outside surface 28, the top surface 29 and the bottom surface 30 at an interface 34 such that the insert 25 is secured from vertical and horizontal motion relative to the plastic overlayer 26. Since the inside surface 27 of the metal insert 25 is not threaded the possibility of rotational movement is remote.

The overlayer 26 covers the top surface 29 of the metal insert 25 forming a sealing surface 31 for a closure (not shown) which cooperatively engages plastic threads 32 formed in the bunghole 23 below the insert 25. An uppermost border 33 of the plastic -to- metal interface 34 is inward from the sealing surface 31 so that no part of the interface 34 is exposed to the atmosphere after insertion of a plug or closure. The plastic overlayer 26 of this embodiment also includes exterior features 35 which may serve to further interjoin with and support pumping and other dispensing equipment attached to the bunghole 23, or support tamperproof cap seals.

Although the upper insert flange 14 in FIG. 1 and the top surface 29 of the metal insert 25 in FIG. 3 are shown as being relatively flat, they should not be construed as so limited. The flatness does provide somewhat of a rigid base against which to compress and mold the sealing surface, thereby decreasing the amount and degree of local deformities thereupon, but warping of the surface and leakage of the plastic -to- metal interface are still eliminated without such a feature.

Also, the metal insert 25 of FIG. 3 need not be limited to the height illustrated. Indeed, the insert 25 can be disklike and still provide enought rigid support to prevent warping of the sealing surface. Additionally, the insert 25 can be threaded to supplement and give support to the plastic threads.

It should be appreciated that the metal insert 10, shown in FIGS. 1 and 2 could have other types of closure retaining means in place of the threads 12. For example, the threads 12 may be replaced with a bayonet type fitting. It should also be appreciated that, as used herein, "bunghole" is intended to mean any opening in a molded container.

Various other advantages of the present invention will be apparent to those skilled in the art and various modifications may be made without departing from the scope and spirit of the attached claims.

What I claim is:

1. A bunghole structure for a plastic container for receiving a closure comprising a tubular metal member having an inside cylindrical surface and outside, top, and bottom surfaces; a plastic overlayer integral with the container covering said outside surface and said top surface, the portion of said overlayer covering said top surface defining a seal, said bunghole structure surrounding an opening in the container, and retaining means for releasably holding the closure in said bunghole with said seal clamped between the closure and said metal member.

2. A bunghole structure, as defined in claim 1, wherein said metal member has circumferential flanges projecting outwardly from said outside surface, said flanges defining said top and bottom surfaces, and wherein said plastic overlayer and said flanges include means securing said metal member from rotational and vertical movement relative to said plastic overlayer.

3. A bunghole structure, as defined in claim 1, wherein said retaining means includes female threads on said inside cylindrical surface for receiving complementary threads on the closure.

4. A bunghole structure, as defined in claim 1, wherein said top surface of said metal member is substantially flat.

5. A bunghole structure for a plastic container for receiving a threaded closure comprising a tubular metal member having an inside cylindrical surface and outside, top, and bottom surfaces, said inside cylindrical surface having female threads for engaging threads on the closure, a plastic overlayer covering said outside surface and said top surface of said metal member, said plastic overlayer forming an exterior portion of the plastic container.

6. A bunghole structure, as defined in claim 5, wherein said metal member has flanges projecting outwardly from said outside surface, said plastic overlayer covering at least one of said flanges, said overlayer and said flanges including means securing said metal member from rotational and vertical movement relative to said plastic overlayer.

* * * * *